US005252081A

United States Patent [19]

Hart

[11] Patent Number: 5,252,081

[45] Date of Patent: Oct. 12, 1993

[54] PLUG FOR USE WITH SELF REGULATING CABLE

[75] Inventor: Robert E. Hart, Ontario, Canada

[73] Assignee: Heron Cable Industries Ltd., Waterloo, Canada

[21] Appl. No.: 103,363

[22] Filed: Feb. 4, 1993

[30] Foreign Application Priority Data

Nov. 19, 1992 [CA] Canada ..... 2083358

[51] Int. Cl.[5] ..... H01R 13/652; H01R 19/08; H01R 13/68

[52] U.S. Cl. ..... 439/98; 439/106; 439/622; 439/696

[58] Field of Search ..... 439/98, 106, 695–697, 439/621, 622, 465, 467, 415–417

[56] References Cited

U.S. PATENT DOCUMENTS 4,067,634 1/1978 Hoffman ..... 439/695
4,072,394 2/1978 Waldron et al. ..... 439/697
4,330,167 5/1982 Chien-Tung ..... 439/622
4,596,432 6/1986 Tighe, Jr. ..... 439/466
4,679,877 7/1987 Ahroni ..... 439/465
4,771,367 9/1988 Serr et al. ..... 439/622
5,002,501 3/1991 Tucker ..... 439/696
5,004,432 4/1991 Tucker ..... 439/417

*Primary Examiner*—Gary F. Paumen
*Attorney, Agent, or Firm*—Sughrue, Mion, Zinn, Macpeak and Seas

[57] ABSTRACT

A plug for use with self-regulating cables or the like is disclosed. The plug enables simple and safe installation of a self-regulating cable or the like into the plug. It also enables an operator to connect the conductors of the plug to the cable conductors with the use of a single screwdriver and without the necessity of stripping or cutting tools. The plug ensures that all conductors are properly connected in addition to providing fuse-link protection to the circuit.

9 Claims, 1 Drawing Sheet

PLUG FOR USE WITH SELF REGULATING CABLE

FIELD OF THE INVENTION

The present invention relates to an electrical plug for use with self-regulating cables or the like and which enables simple and safe installation of a self-regulating cable or the like into the plug.

BACKGROUND OF THE INVENTION

In the past, there has been a need for an electrical plug for use with self-regulating cable or the like that is simple to assemble and that does not require wires to be stripped during assembly.

Conventionally, the assembly of electrical plugs for use with self-regulating cable has required that the insulating material surrounding the cable conductors be stripped using a knife, pliers and/or a lighter in order to completely expose the cable conductors prior to making a connection with the plug housing conductors. Similarly, conventional plugs have required that the external braid of the grounding conductor of the self-regulating cable or the like be cut back and twisted away from the main cable in order to make the appropriate grounding connection to the plug housing ground conductor. These plugs have required additional tools for assembly as well as requiring considerable time and operator skill to ensure proper connection between conductors.

Furthermore, there has also been a need for a plug to provide a simple internal fuse link that provides effective circuit protection and which also eliminates the risk of replacing a burnt out fuse with an improper fuse. Some known plugs have provided circuit protection within the plug housing but with complex mechanical means which contribute to high manufacturing costs and which make the plug prohibitively expensive. Others have provided replaceable fuses but they can be improperly replaced.

U.S. Pat. No. 4,771,367 discloses an electric plug with an internal circuit breaker. This device allows for protection of a circuit from within a plug housing but does not provide a means of simple installation of self-regulating cable or the like. The device is also considerably more complex in providing a number of mechanical parts that comprise both the circuit breaker and the plug housing. Assembly of this plug requires wires be stripped and requires a multiplicity of tools.

U.S. Pat. No. 4,330,167 discloses a fused electric plug with a housing assembly with internal fuse elements. Assembly of this plug requires stripping wires in order to crimp traditional conductive terminals to the ends of the exposed conductors. Furthermore, the plug does not describe a simple means of disassembly to replace burnt out fuses.

U.S. Pat. No. 5,004,432 discloses an electrical connector with an internal fuselink that requires stripping of the insulating material around the cable conductors in order to make electrical connection within the plug housing. The housing of this connector is comprised of several components which add to the complexity of assembly and cost of manufacturing. As well, while the fuse link within this connector is replaceable and could be replaced with an improper fuse.

SUMMARY OF THE INVENTION

It is, therefore, an object of the present invention to address the shortcomings of the conventional plugs referred to above by providing an electrical plug with a plug housing and conductors that enables simple and effective installation of self-regulating cable or the like into a plug housing. Self-regulating cable or the like is normally comprised of an external ground braid surrounding an insulating material which contains internal cable conductors. The present invention enables an installer to insert self-regulating cable or the like into the plug housing and effect connection of the cable conductors to the plug housing conductors with the use of a single screwdriver and without the use of stripping or cutting tools.

Assembly of the present invention with self-regulating cable is also facilitated by providing the two halves of the plug housing with a living hinge such that mating alignment of the halves can be achieved by pivoting the mating surfaces together. Final assembly and securing of the two halves of the plug housing is performed by standard screws between the two halves.

The present invention also provides an internal fuse within the plug housing which provides protection to the circuit in the event of overheating resulting from a surge in power or other electrical event. The fuse is welded or soldered to one of the housing conductors during manufacturing and integrally formed within the plug housing, thereby prohibiting inadvertent replacement with an incorrect fuse. A burnt out fuse is replaced by simple replacement of the entire plug housing.

The configuration of the present invention also provides an effective means of stress release to the portion of cable exiting the plug housing.

In accordance with a broad aspect, the present invention relates to a plug for use with self-regulating cable comprising: a housing means, surrounding and mounting a cable receiving member with integral conducting and grounding pins, and adapted to matingly receive the outer surface of the insulator of a self-regulating cable or the like in a fixed orientation, and piercing means integral with said cable receiving member adapted to pierce the outer surface of the insulator and make electrical contact between the individual conductors of the self-regulating cable and conducting pins.

In accordance with a further aspect, the present invention relates to an electrical plug is comprising: a housing means, surrounding and mounting a cable receiving member with integral conducting and grounding pins, adapted to matingly receive an outer surface of an insulator of a self-regulating cable or the like in a fixed orientation and prevent the external braid of grounding material to enter said cable receiving member, piercing means integral with said cable receiving member adapted to pierce the outer surface of the insulator and make electrical contact between the individual conductors of the self-regulating cable and conducting pins, and a grounding means adapted to make electrical contact between the external braid of grounding material and the grounding pin.

BRIEF DESCRIPTION OF THE DRAWINGS

The invention is illustrated by way of example in the accompanying drawings in which.

DETAILED DESCRIPTION OF THE PREFERRED EMBODIMENT

Figure 1:
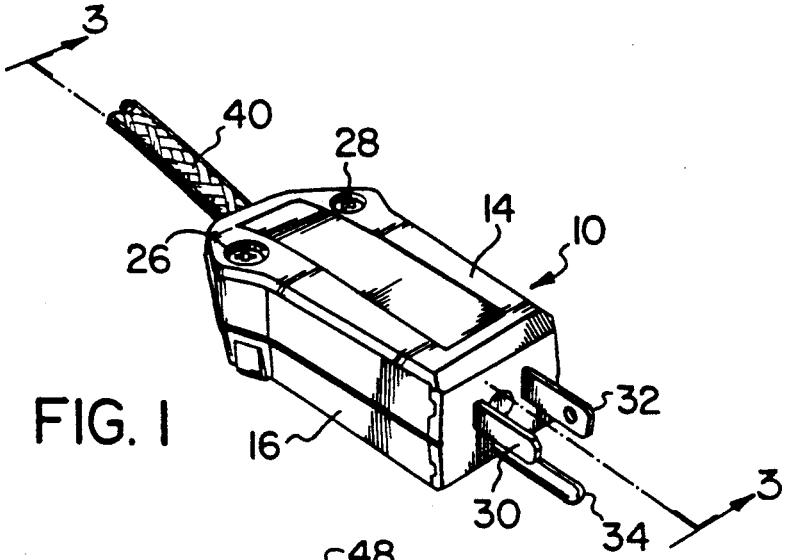
FIG. 1 is a perspective view of the plug and cable.
Figure 2:
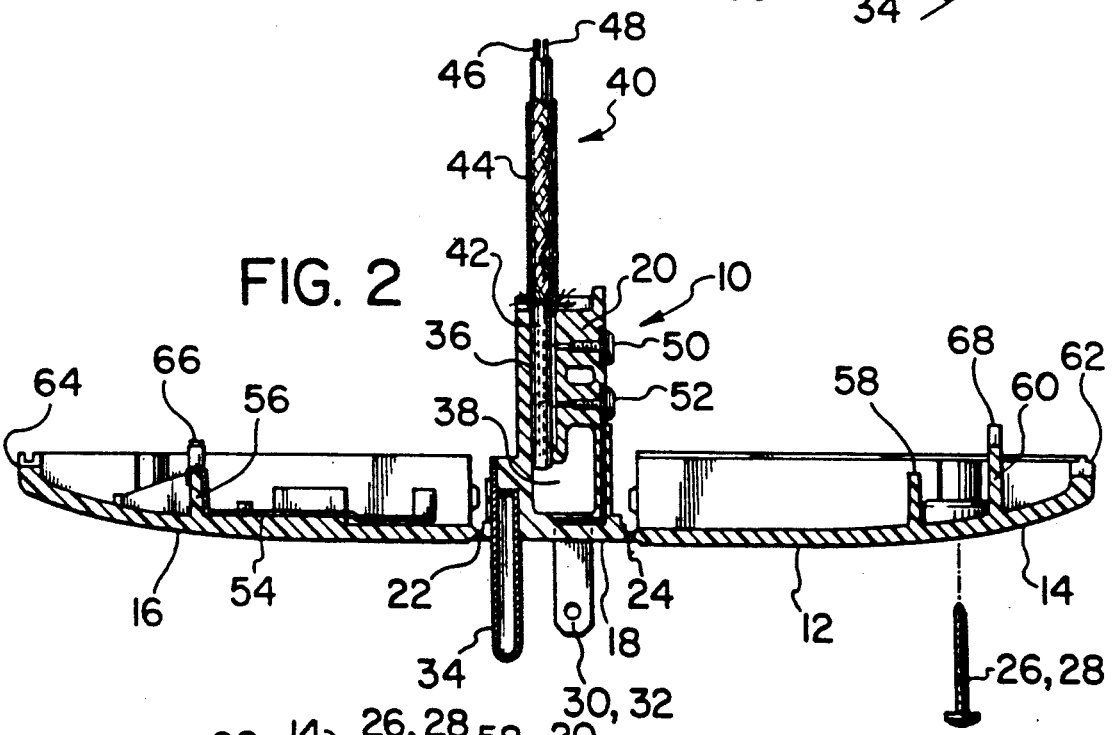
FIG. 2 is a longitudinal cross-sectional view of the plug housing and cable and showing the plug in disassembled form.
Figure 3:
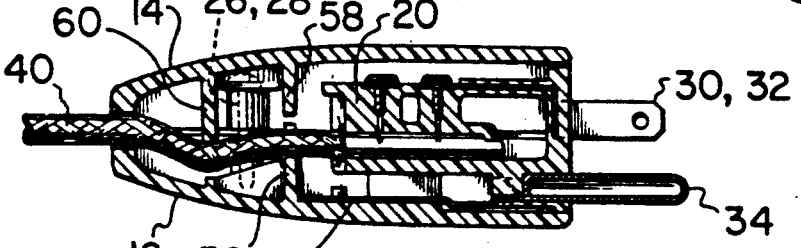
FIG. 3 is a longitudinal cross section of the assembled plug housing and cable taken along the line 3—3 of FIG. 1.

An electric plug 10 in accordance with the preferred embodiment of the invention is illustrated in the drawings. With reference to FIGS. 1, 2 and 3, the plug 10 is generally comprised of a plug housing 12 with two halves 14 and 16, pivotally connected to the front portion 18 of a cable receiving member 20 at hinge positions 22 and 24. The two halves of the plug housing 14 and 16 are of a form to enable them to encase the cable receiving member 20 when pivoted rearwardly of their respective hinge attachments 22 and 24. Anchoring Screws 26 and 28 are used to secure the two halves 14 and 16 together in an assembled position.

The cable receiving member 20 has three conductors integrally formed within its body, power conductors 30 and 32 and ground conductor 34. The power and ground conductors project forwardly and outwardly of the cable receiving member 20. The orientation and configuration of these conductors will typically permit connection to a standard 110 volt outlet. The conductors 30, 32 and 34 are mounted within the cable receiving member 20 during the molding process which forms the overall plug assembly 10.

The rear end of the cable receiving member 20 is characterized by a tunnel 36 extending from generally a middle region of the rear end of the cable receiving member 20 towards the front end thereof, terminating in an open cavity 38 located inwardly of the front face 18 of the cable receiving member 20. The shape and size of the tunnel 36 corresponds to the outside configuration of the core of the self-regulating cable 42 and is adapted to allow passage of the core of the self-regulating cable 42 through the tunnel 36 but not the ground braid 44 of the cable. The cross-section of the tunnel 36 is preferably a non-spherical shape in order to positively orient the cable within the tunnel 36. The shape of the tunnel 36 is designed to position the conductors 46 or 48 of the self-regulating cable within the tunnel 36 such that the conductors 46,48 are aligned with respective piercing means 50 and 52. For example, a typical self-regulating cable core 42 is oval in cross-section with the cable conductors 46 and 48 centred in the curved portion of the oval separated from one another by a semi-conducting matrix. When a cable of this cross-section is pushed into a tunnel 36 of similar cross-section, the cable conductors are always positioned at a specific location within the tunnel 36. Rotation of the cable through 180 degrees will still ensure that the cable conductors 46 and 48 are located in a relatively similar position within the tunnel 36.

The open cavity 38 ensures that the operator can visually check that the end of the cable core 42 is fully pushed through the tunnel.

The cable mounting member 20 is also characterized by two piercing means 50 and 52 mounted between the exterior of the cable mounting member and the tunnel 36, and adapted to make an electrical connection between the cable conductors 46 and 48 and the power conductors 30 and 32 of the cable mounting member 20. The piercing means are typically screws with a pointed tip adapted to penetrate to the conductors 42 or 44 through the insulation matrix of the self-regulating cable 40 when a torquing force from a screwdriver is applied to the head of the screw. As mentioned before, the piercing means 50 and 52 are in electrical contact with the power conductors 30 and 32. The piercing means 50 and 52 are positioned such that when each are tightened, the pointed tips thereof push through the outer casing of the cable and each piercing means makes electrical contact with a single cable conductor 46 and 48.

The plug housing 12 is also adapted to connect the grounding conductor 34 to the grounding braid 44 of the cable 40. A grounding strip 54 is fixed to the inside of the plug housing half 16 such that when the two halves of the plug housing 14 and 16 are brought together during assembly, the grounding strip 54 makes electrical contact with the grounding braid 44 of the cable, proximal to the rear end of the cable receiving member 20, and the grounding conductor 34, proximal the front end of the cable receiving member 20. Tight electrical contact between the grounding braid 44 and the grounding strip is maintained by pressure from the two halves of the plug housing when secured together by anchor screws 26 and 28.

The two halves of the housing 14 and 16, when secured together, also provide a stress release and anchoring means to the cable 40 near the rear of the plug housing 12.

The stress release and anchoring means provides stress release to the cable when it is assembled within the plug housing as well as providing pressure to hold the grounding braid 44 against the grounding strip 54. The stress release and anchoring means is comprised of three components mounted on the plug housing 12; a grounding strip cradle 56, a grounding strip press 58 and a cradle 60, the three components being adapted to urge the cable 40 into a marginally kinked profile during assembly as shown in FIG. 3. The grounding strip cradle 56 and cradle 60 are formed with notches 66 and 68 corresponding to approximately one half of the cross-sectional shape of the cable 40 and adapted to tightly hold the cable 40 in the central portion of the plug housing 12. The cradle 60 projects marginally beyond the midline of the assembled plug housing 12 in order to kink the cable when the two halves of the housing 14 and 16 are brought securely together.

The grounding strip cradle 56 and grounding strip press 58, when assembled, pinch the cable 40 thereby preventing the grounding braid 44 from slipping longitudinally along the cable length. The pinching effect from the grounding strip cradle 56 and grounding strip press 58 further ensure contact of the grounding braid 49 with the grounding strip 54.

The exit channel cradles 62 and 64 are located on the rear of the plug housing halves 14 and 16, respectively . These cradles serve as the exit point of the cable 40 from the plug housing 12 forming an opening which corresponds to the cross sectional shape of the cable 40 when in the mated position. These cradles provide further anchoring and stress release to the cable 40.

Assembly Procedure

Assembly of the present invention with self-regulating cable 40 is achieved with the use of a single screwdriver. The two anchor screws 26 and 28 are removed from the plug housing 12 and the plug housing halves 14 and 16 pivoted forwardly to expose the cable receiving member 20. The piercing screws 50 and 52 are unscrewed in order to permit passage of the core of the self-regulating cable 40 to enter the tunnel 36, the operator ensuring clearance of the cable 40 therein. The self-regulating cable 40 with an external grounding braid 44 is grasped near its end and the core 42 is pushed into the tunnel 36 until it protrudes into the cavity 38. The grounding braid 44 of the cable 40 does not enter the tunnel 36. The two piercing means screws 50 and 52 are then tightened with a screwdriver as far as possible to ensure electrical contact between the cable conductors 46 and 48 and the plug housing conductors 30 and 32. The grounding braid 44 originally encasing the cable core 42 within the tunnel 36 is pressed against the rear end of the cable receiving member 20. The two halves of the housing 14 and 16 are then closed thereby ensuring electrical contact between the grounding strip 54 and the grounding braid 44. Closing the two halves of the housing also provides stress release and anchoring to the cable from the pinching pressures applied to the cable 44 from grounding cradle 56, grounding press 58, cradle 60 and exit cradles 60 and 62. The two anchor screws 26 and 28 are then re-tightened to secure the two halves of the plug housing 14 and 16 together. The plug 10 is then ready for use.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. An electrical plug for use with self-regulating cable, comprising:

a housing means surrounding and mounting a cable receiving member with integral conducting and grounding pins, and adapted to matingly receive the-outer surface of the insulator of a self-regulating cable in a fixed orientation;

piercing means integral with said cable receiving member adapted to pierce the outer surface of the insulator and make electrical contact between the individual conductors of the self-regulating cable and said conducting pins; and a grounding means mounted on said housing adapted to make electrical contact between an external grounding braid of said cable and the grounding pin.

2. An electrical plug as claimed in claim 1 further comprising a fuse integrally attached to one said conducting pin, whereby overheating of said fuse will cause said fuse to fail.

3. An electrical plug as claimed in claim 2 whereby said housing means is comprised of two matable halves pivotally connected to a front face of said cable receiving member, whereby pivotal movement of said halves permits said cable receiving member and piercing means to be encased and further comprising means which permits said halves to be secured together.

4. An electrical plug as claimed in claim 3 where said securing means are screws.

5. An electrical plug as claimed in claim 4 where said piercing means are screws.

6. An electrical plug as claimed in claim 5 wherein said housing means and said cable receiving member are injection moulded from a single mould.

7. An electrical plug as claimed in claim 6 where said housing means further comprises a stress release means adjacent said cable receiving member adapted to anchor said cable in said housing and adapted to relieve stress on said cable from normal operational movement.

8. An electrical plug as claimed in claim 7 where said stress release means comprises a plurality of cradles and presses which pinch said cable when said housing halves are brought securely together during assembly.

9. An electrical plug for use with self-regulating cable comprising:

a housing means, comprising two matable halves with a means which permits said halves to be secured together;

said housing means surrounding and mounting a cable receiving member with integral conducting and grounding pins, adapted to matingly receive an outer surface of an insulator of the self-regulating cable in a fixed orientation and to prevent external grounding braid of the self-regulating cable from entering said cable receiving member;

piercing members integral with said cable receiving member adapted to pierce the outer surface of the insulator and make electrical contact between the individual conductors of the self-regulating cable and said conducting pins;

grounding means adapted to make electrical contact between the external grounding braid of self-regulating cable and the grounding pin;

a fuse integrally attached to one conducting pin, whereby overheating of said fuse will cause said fuse to fail; and a plurality of cradles and presses which pinch said cable when said housing halves are brought together during assembly adapted to provide anchoring and stress release.

* * * * *